US005345952A

United States Patent [19]

Nielander

[11] Patent Number: 5,345,952

[45] Date of Patent: Sep. 13, 1994

[54] PORTABLE CIGARETTE CUTTER, EXTINGUISHER, AND CONVEYANCE APPARATUS

[76] Inventor: Wayne J. Nielander, 2019 G St., Belleville, Kans. 66935

[21] Appl. No.: 178,413

[22] Filed: Jan. 6, 1994

[51] Int. Cl.[5] ..... A24F 13/20

[52] U.S. Cl. ..... 131/248; 131/235.1; 30/113

[58] Field of Search ..... 131/248, 250, 235.1, 131/237, 256; 30/109, 111–113

[56] References Cited

U.S. PATENT DOCUMENTS

| | | | |
|---|---|---|---|
| 1,090,018 | 3/1914 | Bremer . | |
| 1,627,790 | 5/1927 | Macorn et al. | 131/250 |
| 1,637,172 | 7/1927 | Burress . | |
| 2,584,275 | 2/1952 | Lile | 131/237 |
| 2,664,091 | 12/1953 | Thostenson | 131/250 X |
| 4,027,682 | 6/1977 | Halmaghi . | |
| 4,160,318 | 7/1979 | Morel | 131/248 X |
| 4,897,033 | 1/1990 | Yang | 131/250 X |

*Primary Examiner*—Jennifer Bahr
*Attorney, Agent, or Firm*—Phillip A. Rein

[57] ABSTRACT

A portable cigarette cutter, extinguisher, and conveyance apparatus having a container with a cutting blade and sealing assembly mounted therein. A cigarette or article can be inserted through the container into a cigarette or article receiving member having the cutting blade and sealing assembly mounted transversely therein. The cutting blade and sealing assembly includes an actuator member connected to a blade and seal assembly which, in turn, includes a cutting blade member connected to a blade guide and sealing member. The actuator member is operable to conjointly move the cutting blade member and the blade guide and sealing member to 1) first support a cigarette on the blade guide and sealing member; 2) second to actuate, through an actuator button, the cutting blade member and blade guide and sealing member to sever a normally ignited end portion of the cigarette; 3) allowing the severed portion to drop under the force of gravity into the container means; and 4) movable by a bias assembly to a non-actuated condition. The blade guide and sealing member provides a sealing function to prevent oxygen from entering the container means causing extinguishing of any fire contained within the severed portion of the cigarette.

12 Claims, 2 Drawing Sheets

PORTABLE CIGARETTE CUTTER, EXTINGUISHER, AND CONVEYANCE APPARATUS

PRIOR ART

A patent search revealed the following U.S. Pat. Nos.:

| U.S. Pat. No. | Invention | Inventor |
|---|---|---|
| 1,090,018 | POCKET ASH TRAY | Joseph H. Bremer |
| 1,637,172 | CIGARETTE EXTINGUISHER | Raymond E. Burress |
| 2,134,826 | POCKET TYPE CIGARETTE EXTINGUISHER | Henry P. Hoffman |
| 2,253,473 | SMOKER'S DEVICE | Epiphany O. Statelles |
| 2,520,746 | ASH TRAY | Leo Uman |
| 2,521,854 | CIGARETTE AND CIGAR CLIPPING DEVICE | John M. King |
| 2,664,091 | COMBINATION CIGARETTE CASE AND CUTTER | Gilbert Thostenson |
| 2,708,939 | CIGARETTE EXTINGUISHER | Henry A. Fritz |
| 4,027,682 | CIGARETTE EXTINGUISHING AND CIGAR CUTTING DEVICE | Victor Halmaghi |
| 4,897,033 | LIGHTER WITH A CIGARETTE EXTINGUISHER | Bill Yang |

The Bremer patent discloses a pocket ash tray having a blade member which is movable to sever ends of cigars and dropping same into an ash tray collector.

The Burress patent discloses cigarette extinguisher having a cutting blade spring biased to the rest position. The cigarette to be inserted therein rests on a plate and a leaf spring biases the cutting blade to a cigarette cutting position.

The Hoffman patent discloses a guillotine cutting blade on a pocket type cigarette extinguisher.

The Statelies patent discloses a smoker's device having a spring loaded blade for severing ends of cigarettes within a plate for receiving a cigarette thereagainst before severance.

The Uman patent discloses an ash tray having blade members which are operable to sever an ignited cigarette end.

The King patent discloses a cigarette and cigar clipping device having a spring biased guillotine structure which is moved against a bias compression spring member during a severing operation.

The Thostenson patent discloses a combination cigarette case and cutter having a rather simple cutter blade.

The Fritz patent discloses a cigarette extinguisher having a spring biased cutting blade.

The Halmaghi patent discloses a cigarette extinguishing and cigar cutting device having a push button, spring biased, cutting blade.

The Yang patent discloses a lighter with a cigarette extinguisher having cutter blades and an enclosed area to hold a severed cigarette end.

PREFERRED EMBODIMENT OF THE INVENTION

In one preferred embodiment of a portable cigarette cutter, extinguisher, and conveyance apparatus of this invention, a container means is provided with a cutting blade and sealing assembly or means is connected thereto being operable to receive a cigarette or article for purposes of severing a portion thereof and retaining the severed portion therein.

The container means includes a lower reservoir assembly with an upper enclosure and receiver assembly releasably connected thereto.

The lower reservoir assembly includes a cylindrical cup shaped housing member having a bottom wall section integral with a cylindrical side wall section having an upper male threaded portion to be connected to the upper enclosure and receiver assembly.

The upper enclosure and receiver assembly includes a cylindrical housing enclosure having an article receiving member connected thereto. The cylindrical housing enclosure includes a top wall section integral with a side wall section. A lower outer edge of the side wall section is formed with a female threaded portion operable to be releasably connected to the male threaded portion on the lower reservoir assembly.

The top wall section is provided with an article entrance opening to receive an article or cigarette therethrough into the article receiving member and the interior of the container means.

The side wall section is provided with the female threaded portion and, additionally, an actuator member aperture to receive a portion of the cutting blade and sealing assembly therethrough and a bias support member slot on an inner side wall surface also to receive a portion of the cutting blade and sealing assembly therein.

The article receiving member is integral with the top wall section of the cylindrical housing assembly enclosure and receiver assembly and depending downwardly therefrom. The article receiving member includes a main support body having a central opening or hole and formed with an upper entrance section integral with a middle section which, in turn, is integral with a lower or discharge section.

The middle section is formed with opposed cooperating cutting blade member slots. The lower or discharge section is provided with a pair of cooperating blade assembly alignment slots, both sections are operable with a portion of the cutting blade and sealing assembly as will be noted.

Further, the discharge section is provided with a discharge aperture or opening whereupon a severed cigarette or article is dispensed therethrough for support, containment, and conveyance in the lower reservoir assembly.

The cutting blade and sealing assembly includes an actuator member which is mounted transversely of the container means and, at one end thereof, connected to a blade and seal assembly. The blade and seal assembly is mounted within the container means, intersects the article receiving member, and, on one end, is connected to the actuator member for reasons to become obvious.

The actuator member is mounted through the actuator member aperture in the side wall section of the upper enclosure and receiver assembly.

The blade and seal assembly includes 1) a cutting blade member; 2) a blade guide and sealing member connected to the cutting blade member; and 3) a bias assembly mounted between the blade guide and sealing member and an inside surface of the article receiving member.

The cutting blade member is provided with a support section integral with an inclined riser section which, in turn, is integral with a cutting blade section.

The cutting blade section has an arcuate cutting portion with a sharp portion or edge which is operable to sever the cigarette or article within the article receiving member as will be noted.

The blade guide and sealing member includes a connector support section integral with a middle section which, in turn, is integral with an outer support lug and projection.

The connector support section is mounted on the connector support section of the cutting blade member and held in a clamped relationship when mounted within a blade assembly support slot in the actuator member.

The middle section includes an article receiving aperture or opening positioned within an outer sealing portion. The article receiving aperture is of oblong shape having an oblong edge wall for reasons to be explained.

The sealing portion is operable to extend transversely of the central hole in the main support body of the article receiving member when in a sealed condition and being movable transversely of the central hole to allow a severed article or cigarette portion to fall downwardly under the force of gravity into the lower reservoir assembly of the container means.

The outer support lug or projection is connected to the bias assembly and operable to return the interconnected cutting blade member and blade guide and sealing member to a non-use condition after an cigarette or article severing operation.

The bias assembly includes a compression spring member having one end mounted about a support plate member. The support plate member is anchored internally of the upper enclosure and receiver assembly against the side wall section in a bias support member slot.

The compression spring member includes a lug connector end section which is connected to the outer support lug on the blade guide and sealing member and a plate end connector section connected to the support plate member.

The compression spring member operates to bias the cutting blade member and interconnected blade guide and sealing member outwardly towards the actuator member which is selectively depressed against the force of the compression spring member during a cigarette or article cutting operation.

OBJECTS OF THE INVENTION

One object of this invention is to provide a portable cigarette cutter, extinguisher, and conveyance apparatus including a container means having a cutting blade and sealing assembly connected to the container means being operable to receive a portion of an ignited cigarette therein with the cutting blade and sealing assembly operable to 1) provide a stop plate to receive the ignited cigarette thereagainst; 2) move a cutting blade transversely of the cigarette to sever an outer end portion thereof; 3) provides movement of an aperture to allow the severed cigarette portion to drop downwardly into a lower portion of the container means; and 4) move to a retracted position to seal the lower portion of the container means so that any ignited portion of the severed cigarette will be extinguished due to lack of oxygen in the container means.

Another object of this invention is to provide a portable cigarette cutter, extinguisher, and conveyance apparatus provided with 1) a container means having an entrance opening integral with a hole in an article receiving member; and a2) cutting blade and sealing assembly connected to the container means and engagable with the article receiving member in such a manner as to a) first receive a cigarette or article on a support member; b) sever the cigarette or article a predetermined distance from the support member; c) allow the severed cigarette or article to fall through an article receiving aperture into the container means; and d) move to a retracted or inactive position to seal the hole in the article receiving member.

One other object of this invention is to provide a portable cigarette cutter, extinguisher, and conveyance apparatus having 1) a container means having a cutting blade and sealing assembly mounted therein operable to receive a cigarette or article extended through an opening in the container means; 2) an article receiving member having a longitudinal hole integral with the opening in the container means; and 2) a cutting blade and sealing assembly having a cutting blade member connected to a blade guide and sealing member; all being operable to sever a positioned cigarette or article inserted in the hole with the cutting blade member, allow the severed portion of the cigarette or article to fall under the force of gravity through an article receiving aperture in the blade guide and sealing member into the container means, and retract the interconnecting cutting blade member and blade guide and sealing member to a first inoperative position to seal the hole through the article receiving member so that the severed cigarette or article will be contained within an airtight portion of the container means and any hot ashes from the cigarette would be extinguished.

One further object of this invention is to provide a portable cigarette cutter, extinguisher, and conveyance apparatus operable to permit a cigarette smoker to place an ignited cigarette therein, sever off the burning portion, retain the remaining portion of the cigarette for future use, and, thus, providing a substantial monetary savings to a cigarette or cigar smoker user of this invention.

Still, one other object of this invention is to provide a portable cigarette cutter, extinguisher, and conveyance apparatus which is of a convenient size to be readily portable; easy to use; economical to manufacture; providing monetary savings in the purchase of cigarettes during usage; and substantially maintenance free.

Various other objects, advantages, and features of the invention will become apparent to one skilled in the art from the following discussion, taken in conjunction with the accompanying drawings, in which:

FIGURES OF THE INVENTION

Figure 1:
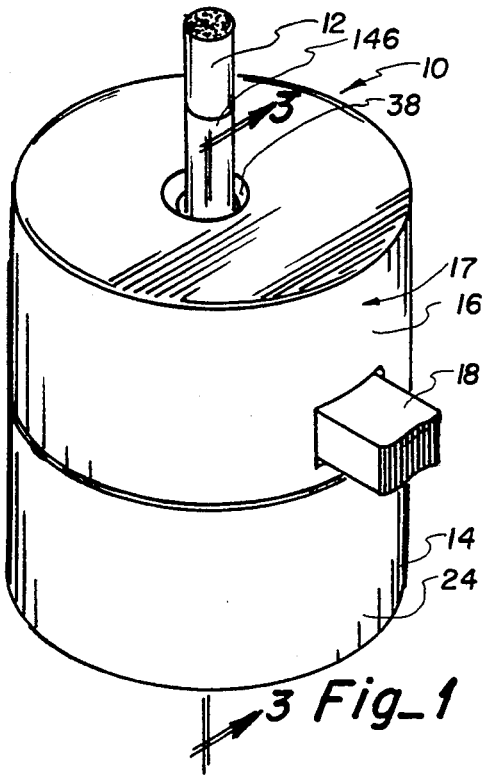
FIG. 1 is a perspective view of the portable cigarette cutter, extinguisher, and conveyance apparatus of this invention.

The following is a discussion and description of preferred specific embodiments of the portable cigarette cutter, extinguisher, and conveyance apparatus of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Referring to the drawings in detail, and in particular to FIG. 1, a portable cigarette cutter, extinguisher, and conveyance apparatus of this invention, indicated generally at 10, includes a container means 17 having a cutting blade and sealing assembly or means 18 connected thereto.

The container means 17 includes a lower reservoir assembly 14 having an upper enclosure and receiver assembly 16 releasably connected thereto. The lower reservoir assembly 14 includes a cylindrical housing member 20 having a bottom wall section 22 integral with a cylindrical side wall section 24.

The cylindrical side wall section 24 is provided at an upper outer edge thereof with a male threaded portion 26 to be releasably secured to the upper enclosure and receiver assembly 16 as will be noted.

Figure 2:
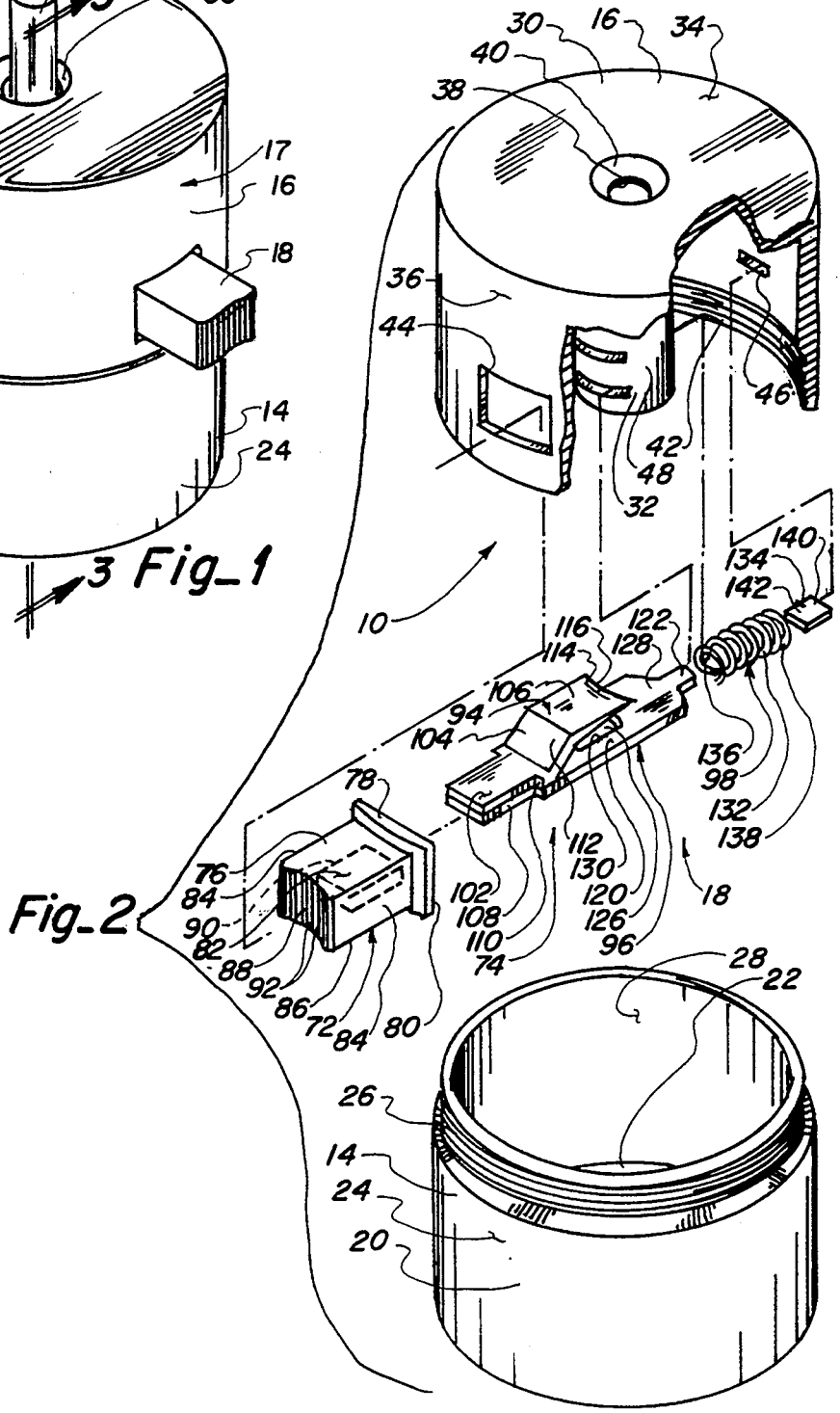
FIG. 2 is an exploded perspective view thereof.

As noted in FIG. 2, the upper enclosure and receiver assembly 16 includes a cylindrical housing enclosure 30 with a cigarette or article receiving member 32 connected to or integral therewith.

The cylindrical housing enclosure 30 is provided with a top wall section 34 integral with a side wall section 36. The top wall section 34 is provided centrally with a cigarette or article receiving entrance opening 38 integral with a tapered flange section 40.

The side wall section 36 is provided near an outer peripheral edge with a female threaded portion 42; an actuator member aperture or opening 44; and, opposite the actuator member aperture or opening 44, is a bias support member slot 46 for reasons to be explained.

Figure 4:
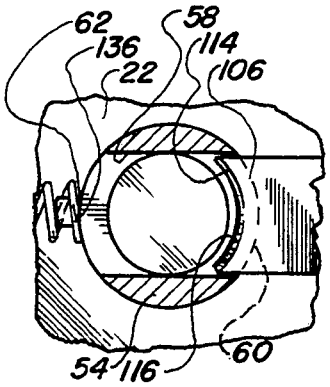
FIG. 4 is an enlarged fragmentary sectional view taken along line 4—4 in FIG. 3.
Figure 5:
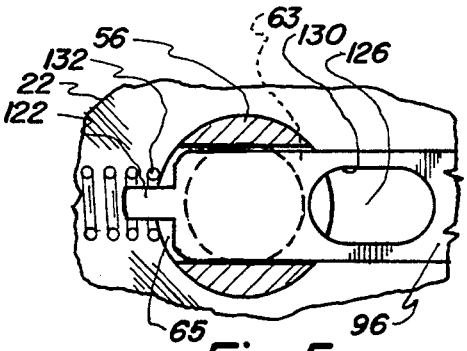
FIG. 5 is an enlarged fragmentary sectional view taken along line 5—5 in FIG. 3.
Figure 6:
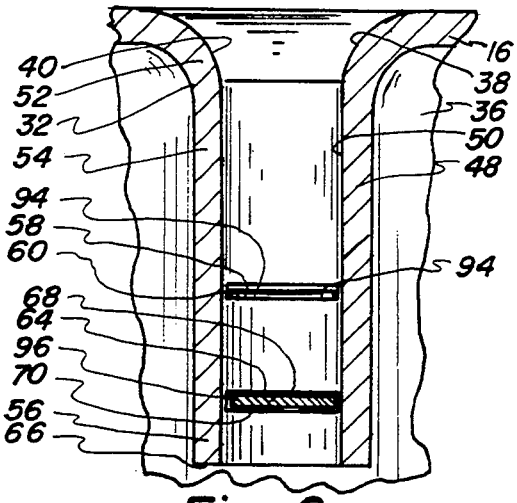
FIG. 6 is a fragmentary enlarged sectional view taken along line 6—6 in FIG. 3.

As noted in FIG. 4, the cigarette or article receiving member 32 is provided with a main tubular support body 48 having a central opening or hole 50 therethrough leading to the interior of the container means 17 and, namely, the lower reservoir assembly 14.

The main tubular support body 48 includes 1) an upper entrance section 52 integral with the tapered flange section 40 of the top wall section 34; 2) a middle section 54 integral with a lower portion of the upper entrance section 52; and 3) a lower discharge section 56 integral with a lower portion of the middle section 54.

The middle section 54 includes a pair of opposed cutting blade member slots 58 cooperating to receive a portion of the cutting blade and sealing assembly 18 therethrough as will be explained. The cutting blade member slots 58 are provided with an entrance section 60 and an exit section 62.

The lower or discharge section 56 is provided with a pair of opposing blade assembly alignment slots 64 cooperating to receive a portion of the cutting blade and sealing assembly 18 therethrough as will be explained. The blade assembly alignment slots 64 are provided with an upper seal surface 68 and a lower seal surface 70; plus a first seal portion 63 and a second seal portion 65.

Further, the lower or discharge section 56 is provided with a discharge aperture or opening 66 leading into the lower reservoir assembly 14 whereupon severed articles or cigarette portions in the article receiving member 32 fall therethrough under the force of gravity for support and conveyance purposes.

The cutting blade and sealing assembly 18 includes an actuator member 72 mounted within the actuator member aperture or opening 44 and connected to a blade and seal assembly 74. The actuator member 72 includes a main button housing 76 integral with an outwardly extending retaining flange section 78.

Figure 3:
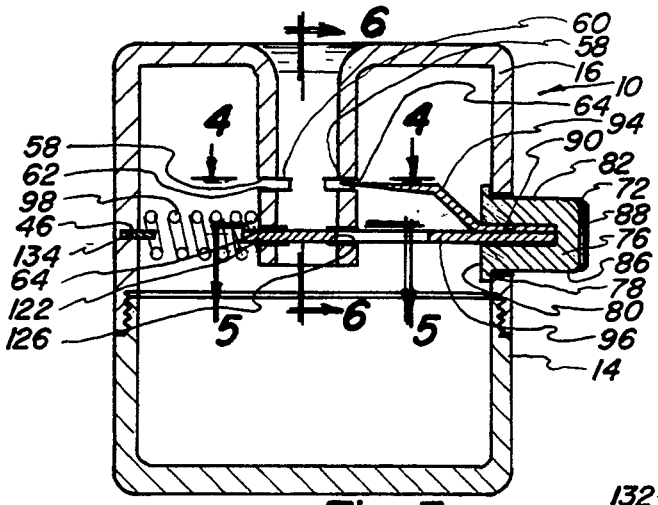
FIG. 3 is a sectional view taken along line 3—3 in FIG. 1.

The main button housing 76 is adapted to be placed through the actuator member aperture or opening 44 and having the laterally extended retaining flange section 78 engagable with an inner surface of the upper enclosure and receiver assembly 16 as noted in FIG. 3.

The main button housing 76 includes 1) an inner wall 80; 2) a top wall 82; 3) opposed side walls 84; 4) a bottom wall 86; 5) an arcuate front wall 88; and 6) an internal blade assembly support aperture or slot 90. The arcuate front wall 88 is provided with parallel serrations 92.

The blade assembly support aperture or slot 90 is operable to receive a portion of the blade and seal assembly 74 which also will bias a portion of the actuator member 72 laterally of the actuator member aperture or opening 44 in the upper enclosure and receiver assembly as will be explained.

The blade and seal assembly 74 includes 1) a cutting blade member 94; 2) a blade guide and sealing member 96 which is secured to or positioned against a portion of the cutting blade member 94; and 3) a bias assembly 98 having one end engagable with an inner surface of the upper enclosure and receiver assembly 16 and another end engagable with a portion of the blade guide and sealing member 96.

The cutting blade member 94 is provided with a connector support section 102 integral with an inclined riser section 104 which, in turn, is integral with a cutting blade section 106. The connector support section 102 includes a rectangular plate portion 108 which, in turn, is integral with opposed shoulder portions 110.

The inclined riser section 104 extends upwardly from the connector support section 102 and being a rectangular plate section 112.

The cutting blade section 106 is provided with an arcuate cutting portion 114 integral with an outer arcuate sharp tip portion 116. The cutting blade section 106 is operable to sever a portion of the cigarette or article within the cigarette or article receiving member 32 in a manner to be described.

The blade guide and sealing member 96 is provided with a connector support section 102 integral with a middle section 120 which, in turn, is integral with an outer support lug or projection 122. The connector support section 102 is noted to be identical to the connector support section 102 of the cutting blade member 94 having a rectangular plate portion 108 integral with a shoulder portion 110.

The middle section 120 is provided with an article receiving aperture or opening 126 and an outer sealing portion 128 which, in turn, is integral with the outer support lug or projection 122.

The article receiving aperture or opening 126 is preferably of an oblong shape having an oblong edge wall 130. A long axis of the oblong article receiving aperture or opening 126 extends parallel to the longitudinal axis of the blade guide and sealing member 96 for reasons to be explained.

A short axis of the oblong article receiving aperture or opening 126 is of a size greater than the diameter of the central opening or hole 50 in the cigarette or article receiving member 32 for reasons to be explained.

The bias assembly 98 includes a compression spring member 132 and a support plate member 134. The compression spring member 132 includes a lug connector end section 136 to be mounted on the outer support lug or projection 122 of the blade guide and sealing member 96 and, further, a plate connector end section 138 to be mounted on the support plate member 134.

The support plate member 134 has a connector section 140 operable to be securely mounted within the bias support member slot 46 in the side wall section 36 of the upper enclosure and receiver assembly 16 and a projection section 142 is operable to receive the plate connector end section 138 of the compression spring member 132 thereabout.

USE AND OPERATION OF THE INVENTION

In the use and operation of the portable cigarette cutter, extinguisher, and conveyance apparatus 10 of this invention as noted in FIG. 3, this is in a first non-usage or retracted position whereupon the compression spring member 132 is mounted about the support plate member 134 and the outer support lug or projection 122 on the blade guide and sealing member 96. This operates to bias the entire cutting blade and sealing assembly 18 with the actuator member 72 positioned transversely of the side wall section 36 of the upper enclosure and receiver assembly 16.

In this non-usage condition, it is noted that the cutting blade member 94 is extended outwardly of the central opening or hole 50 in the cigarette or article receiving member 32. The inner surface 28 of the blade guide and sealing member 96 extends transversely of the central opening or hole 50 and provides a sealing function.

On use by a cigarette smoker, an outer end of an ignited cigarette 12 would be inserted into the cigarette or article entrance opening 38 as noted by an arrow 46, past the tapered flange section 40, and into the central opening or hole 50 so that a lower ignited end of the cigarette 12 would rest on the sealing portion 128 of the blade guide and sealing member 96.

It is noted that the distance between the cutting blade section 106 of the blade and seal assembly 74 and the blade guide and sealing member 96 determines the length of the outer portion of the cigarette 12 to be severed. This distance is calculated to provide a severance of the outer end of the cigarette 12 which will include all hot, ignited portion thereof.

Figure 7:
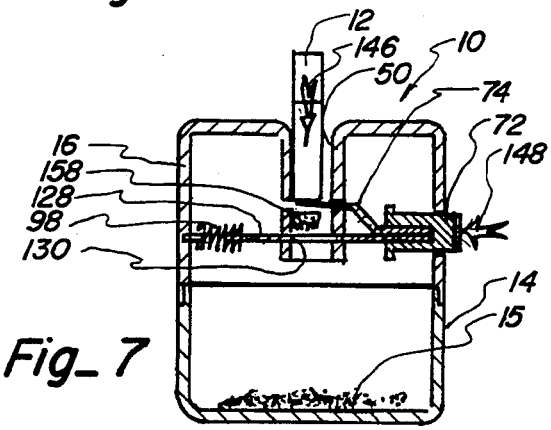

In the next procedure, as noted in FIG. 7, the user of this invention would depress the actuator member 72 as noted by an arrow 148. This causes the cutting blade member 94 and the blade guide and sealing member 96 to move transversely of the central opening or hole 50 in the article receiving member 32. The cutting blade section 106 and, namely, the sharp tip portion 116 of the cutting blade member 94 contacts the cigarette 12 to proceed with a slicing or severing action.

Concurrently, the blade guide and sealing member 96 moves longitudinally to place the article receiving aperture or opening 126 directly below the severed outer end of the cigarette 12. With the oblong shape of the article receiving aperture or opening 126 being of at least the same diameter and longer than the diameter of the central opening or hole 50, this guarantees that the outer severed end portion of the cigarette 12 will fall downwardly into the lower reservoir assembly 14. This is noted in FIG. 8 by an arrow 156 with the severed end portion indicated at 158.

Figure 8:
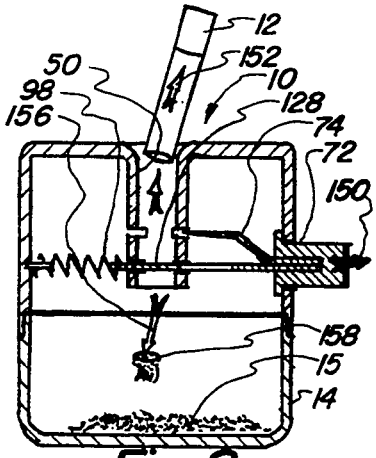
FIGS. 7 and 8 are schematic diagrams illustrating the use and operation of the invention.

On releasing pressure against the actuator member 72, it would move outwardly as noted by an arrow 150 into the first retracted or inactive position as shown in FIGS. 3 and 8.

At this time, the cigarette 12 is removed from the central opening or hole 50 as noted by an arrow 152 in FIG. 8.

In the position with the sealing portion 128 of the blade guide and sealing member 96 covering and sealing the central opening or hole 50, it is noted that atmospheric air with oxygen cannot enter the container means 17 and, more particularly, the lower reservoir assembly 14. Therefore, the hot ashes contained in the severed end portion 158 of the cigarette 12 will be quickly extinguished due to lack of oxygen.

The cigarette smoker using the invention will retain the cigarette 12 without the severed portion 158 as noted in FIG. 8 and store in a cigarette pack for further usage. This provides a large monetary savings for the user of the portable cigarette cutter, extinguisher, and conveyance apparatus 10 of this invention and, therefore, the monetary savings by having the retained cigarettes 12 will quickly pay for the cost of the invention noted herein.

The portable cigarette cutter, extinguisher, and conveyance apparatus 10 can be increased in size and provide a similar function to a cigar smoker, namely, to sever off the ignited end of a cigar so that it can be saved for future usage and, again, providing a large monetary savings in the smoking of cigars through this invention.

Additionally, it is noted that the portable cigarette cutter, extinguisher, and conveyance apparatus 10 can be used with other items for severing off an end portion, such as a straw, piece of wood, etc.

The portable cigarette cutter, extinguisher, and conveyance apparatus of this invention is compact in size for easy conveyance; easy to operate; economical to manufacture; providing a monetary savings in cigarettes which normally would be extinguished and discarded before the entire length thereof was smoked; and substantially maintenance free.

While the invention has been described in conjunction with preferred specific embodiments thereof, it will be understood that this description is intended to illustrate and not to limit the scope of the invention, which is defined by the following claims:

I claim:

1. A portable cigarette cutter, extinguisher and conveyance apparatus, comprising:

a) a container means adapted to receive, convey and extinguish portions of a cigarette and its ashes;

b) said container means including an upper enclosure and receiver assembly having a cigarette entrance opening leading to a cigarette receiving member having a hole integral with said cigarette entrance opening so that a cigarette can be inserted therethrough;

c) a blade and sealing assembly movably connected to said container means, said blade and sealing assembly comprising a cutting blade member connected to a blade guide and sealing member, said blade guide and sealing member having an aperture therein;

d) an actuator member mounted on said container means for moving said cutting blade member and said blade guide and sealing member transversely of said hole between a first position in which said cutting blade member is positioned outwardly of said hole and said blade guide and sealing member covers said hole to seal the interior of said container means and a second position in which the cutting blade member transverses said hole to sever off an end portion of a cigarette inserted through said receiving member and said aperture in said blade guide and sealing member is positioned transversely of said hole, thereby allowing the severed end to drop through said aperture into the lower reservoir.

2. A portable cigarette cutter, extinguisher, and conveyance apparatus as described in claim 1, wherein:

a) said container means having a lower reservoir assembly releasably connected to an upper enclosure and receiving assembly; and b) said cigarette entrance opening is provided with an integral outwardly tapered flange section for ease of finding said cigarette entrance opening when placing a cigarette therein.

3. A portable cigarette cutter, extinguisher, and conveyance apparatus as described in claim 1, wherein:

a) said cigarette receiving member having a main support body provided with cutting blade slots and blade assembly alignment slots to receive said cutting blade member and said blade guide and sealing member, respectively, therethrough;

b) said actuator member extended laterally of said container means and operable to be pushed inwardly in an activated cigarette severing operation.

4. A portable cigarette cutter, extinguisher, and conveyance apparatus as described in claim 1, wherein:

a) said cutting blade member and said blade guide and sealing member are conjointly movable back to the first position with said cutting blade member extended outwardly of said hole and said blade guide and sealing member movable over said hole to seal said container means and any hot ashes therein from the severed end portion of the cigarette will be quickly extinguished for lack of oxygen in said container means.

5. A portable cigarette cutter, extinguisher, and conveyance apparatus as described in claim 1, wherein:

a) said blade and sealing assembly includes a bias assembly connected between said blade guide and sealing member and said container means and operable to bias said actuator member outwardly to the inactive condition after a cutting operation.

6. A portable cigarette cutter, extinguisher, and conveyance apparatus as described in claim 1, wherein:

a) said aperture in said blade guide and sealing member being of an oblong shape of a size greater than said hole in said cigarette receiving member so that inward movement of said actuator member assures that the severed end portion of the cigarette falls downwardly through said oblong opening into said container means.

7. A portable article cutter and conveyance apparatus, comprising:

a) a container means adapted to receive and convey portions of an article;

b) said container means includes an article entrance opening integral with an article receiving member operable to receive the article extended through said article entrance opening and said article receiving member;

c) said article receiving member having a hole in line with said article entrance opening to receive the article therethrough;

d) a cutting blade and sealing assembly operably connected to said article receiving member;

e) said cutting blade and sealing assembly includes a blade and seal assembly operably connected to said container means and said article receiving member;

f) said blade and seal assembly includes a cutting blade member and a blade guide and sealing member both movable transversely of said hole in said article receiving member, said blade guide and sealing member having an article receiving aperture therein;

g) said blade and seal assembly movable between a first position wherein said cutting blade member is positioned outwardly of said hole and said blade guide and sealing member covers said hole to seal the interior of said container means and a second position wherein said cutting blade member transverses said hole to sever a portion of an article placed in said hole and positioned below said cutting blade member and said aperture in said blade guide and sealing member is positioned transversely of said hole to allow the severed portion of the article to pass through said aperture for retention in said container means.

8. A portable article cutter, and conveyance apparatus as described in claim 7, wherein:

a) said cutting blade member and said blade guide and sealing member are securely interconnected to each other for concurrent and joint movement transversely of said hole;

b) said cutting blade and sealing assembly includes an actuator member extended transversely of said container means and connected to the interconnected said cutting blade member and said blade guide and sealing member for moving transversely of said container means; and c) said blade and seal assembly includes a bias assembly connected to an opposite end of said blade guide and sealing member operable to bias the interconnected said cutting blade member and said blade guide and sealing member to the first position after moving transversely of said hole in a severing operation.

9. A portable article cutter, and conveyance apparatus as described in claim 8, wherein:

a) said bias assembly includes a compression spring member mounted between said container means and said blade guide and sealing member operable to bias said actuator member outwardly of said container means.

10. A portable article cutter, and conveyance apparatus as described in claim 7, wherein:

a) said container means includes a lower reservoir assembly releasably connected to an upper enclosure and receiver assembly;

b) said article receiving member is connected to said upper enclosure and receiver assembly;

c) an article placed through said hole and said article entrance opening is supported on said blade guide and sealing member at a predetermined depth within said container means;

d) said cutting blade and sealing assembly includes an actuator member connected to said cutting blade member;

e) said actuator member is operable to move said cutting blade member and said blade guide and sealing member transversely of said hole from the first position wherein said cutting blade member is positioned laterally of said hole and said blade guide and sealing member is extended across said hole to provide support for an article placed thereon plus seal said hole leading to said lower reservoir assembly; and e) said actuator member is operable in a cutting operation to move said cutting blade member transversely of said hole to sever the article contained therein and, after a severing operation, a severed article previously resting on said blade guide and sealing member falls through said article receiving aperture to fall into said lower reservoir assembly for retaining and conveyance purposes.

11. A portable article cutter, and conveyance apparatus as described in claim 7, wherein:

a) said article receiving aperture is of an oblong shape with a large axis thereof extended along a longitudinal axis of said blade guide and sealing member and, due to the oblong nature of said article receiving aperture, is assured of providing a clear opening about said hole for the severed article portion to fall into said container means.

12. A portable article cutter, and conveyance apparatus as described in claim 10, wherein:

a) said upper enclosure and receiver assembly having an upright side wall portion with said actuator member mounted therein and said actuator member is moved transversely of said upright side wall portion during a severing operation and moved to a retracted position under force of a bias assembly, said bias assembly being mounted between said container means and said blade guide and sealing member; and b) after a severing operation, said bias assembly moves said cutting blade member and said blade guide and sealing member conjointly to the first position to provide a sealing action with said hole to prevent severed articles within said container means from being dislodged therefrom.

* * * * *